United States Patent [19]

DuRocher

[11] 4,100,054

[45] Jul. 11, 1978

[54] COMBINATION INSULATING SLEEVE AND ELECTRICAL CONTACT MEMBER FOR ELECTRO-PLATING RACK

[75] Inventor: Gideon A. DuRocher, Mt. Clemens, Mich.

[73] Assignee: Essex Group, Inc., Fort Wayne, Ind.

[21] Appl. No.: 777,281

[22] Filed: Mar. 11, 1977

[51] Int. Cl.[2] ..... C25D 17/06

[52] U.S. Cl. ..... 204/297 W; 204/285

[58] Field of Search ..... 204/281, 297 R, 297 W, 204/297 M, 285

[56] References Cited

U.S. PATENT DOCUMENTS

| | | | |
|---|---|---|---|
| 3,484,361 | 12/1969 | Sperry | 204/297 W |
| 4,014,778 | 3/1977 | Harrison | 204/297 W |

*Primary Examiner*—F.C. Edmundson

*Attorney, Agent, or Firm*—Lawrence E. Freiburger; Robert D. Sommer

[57] ABSTRACT

A pressure sensitive electrical contact member which surrounds a first electrical conductor and completes an electrical connection between the first conductor and a second electrical conductor in response to relative pressure exerted thereon by the two conductors. As an example, the pressure sensitive electrical contact member may be used as an insulating sleeve which surrounds that portion of an electro-plating rack upon which the articles to be plated are supported. The sleeve includes a pressure sensitive electrical contact portion which is normally nonconductive but becomes conductive when the article to be plated is placed on the rack so as to complete an electrical connection between the article and the rack. Because only substantially that portion of the pressure sensitive electrical contact that the article contacts is electrically conductive, the effects of parasitic plating on the rack are greatly minimized.

3 Claims, 5 Drawing Figures

COMBINATION INSULATING SLEEVE AND ELECTRICAL CONTACT MEMBER FOR ELECTRO-PLATING RACK

BACKGROUND OF THE INVENTION

The electro-plating process has been used commercially for years to plate metal articles with a coating of another metal. While the process itself is well understood and controlled, one of the biggest problems which still remains to be solved is that of parasitic plating. In the typical electro-plating process, the article to be plated is supported on an arm, or a plurality of arms, of a plating rack which moves along a conveyor and serves to dip the articles into an electrolyte bath. Since by the nature of the process the article serves as an electrode, in order to make an electrical connection to the article, the rack is by necessity an electrode also. Thus, when plating of the article occurs, any portion of the rack which is also in contact with the electrolyte bath is plated also. The rack eventually collects so much parasitic plating it becomes useless, and it is necessary to either destroy the rack or remove the plating so that the rack can be reused.

One solution to this problem of parasitic plating has been to cover essentially all that portion of the rack which is submerged into the electrolyte bath with an insulating material such as a plastisol. The portion of the rack arm upon which the article is supported, is left bare, of course, so that the necessary electrical connection between the article and the rack is completed. While this has substantially reduced the amount of parasitic plating, parasitic plating still occurs at the junction of article and the plating rack. In fact, under certain circumstances, it is still necessary to remove the parasitic plating from the rack as often as every two or three trips through the plating bath.

It is clear, therefore, that the electro-plating process can be made much more economical if the parasitic plating problem can be greatly minimized.

SUMMARY OF THE INVENTION

It is thus an object of the present invention to minimize the problem of parasitic plating in the electro-plating process. It is an additional object of the present invention to provide a combination insulative sleeve and electrical contact member for an electroplating rack which insulates the rack and serves to provide an electrical connection between the article and the plating rack. In its broadest aspects, however, it is an object of the invention to provide a pressure sensitive electrical connection between two electrical conductors.

These objects as well as others which will become apparent as the description of the invention proceeds are accomplished by the sleeve of the present invention. The sleeve of the present invention structurally is a closed, round tubular sleeve which is adapted to be inserted onto a first electrical conductor such as a plating rack arm. In addition, the sleeve of the invention has a pressure sensitive electrical contact area constructed of pressure sensitive contact material which is normally nonconductive but becomes conductive in response to the pressure exerted on it by the weight of the article to be plated.

The sleeve and electrical contact area are preferably formed of resilient, compressible electrically nonconductive material of sufficient strength to withstand the rough handling it will receive in a production environment. In addition, it is necessary that the materials from which the sleeve and contact material are constructed be able to withstand the various chemicals used in the electro-plating process. Further, the electrical contact area is preferably formed of a mixture of the same material from which the remainder of the sleeve is constructed, and a plurality of electrically conductive particles so as to render it normally electrically nonconductive but responsive to pressure to become increasingly more conductive in response to increased pressure. Applicant has found that one such suitable material for the sleeve and a base material for the contact area is chosen from the group of materials generally known as plastisols.

The sleeve and pressure sensitive contact area may be essentially of any geometry. However, since most plating racks have a round arm, the sleeve is preferably of a round, tubular closed configuration. Further, the contact area need not be unnecessarily large and can take the configuration of a raised ring-like portion on the tubular sleeve.

BRIEF DESCRIPTION OF THE DRAWING FIGURES

During the course of the detailed description of the preferred embodiment of the invention, reference will be made to the drawings in which.

DETAILED DESCRIPTION OF THE INVENTION

Figure 1:
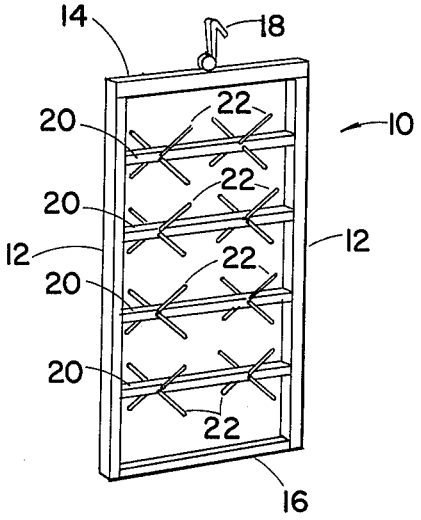
FIG. 1 is an isometric drawing of an electro-plating rack employing the combination insulating sleeve and electrical contact in accordance with the present invention.

Referring now to the drawings, and particularly FIG. 1, an electro-plating rack, generally indicated by reference numeral 10 includes a frame consisting of side members 12, a top member 14, and a bottom member 16. The top member 14, has a supporting hook 18 attached to it which serves as a mounting and an electrical connection member for electrically connecting the rack 10 to a conveyor apparatus. Additionally, the rack 10 has a plurality of parallel cross members 20, each attached to and running between side members 12. A plurality of supporting arms 22 are shown extending outwardly from each cross member 20. The supporting arm construction is well known in the art; therefore it should suffice to say that each supporting arm 22 is structurally and electrically attached to its supporting cross member 20. In the electro-plating rack depicted in the drawings, the support arms 22 are arranged in pairs and each article to be plated is supported on a pair of support arms by pinching them together and placing the article thereover. It will be clear to those skilled in the art that the configuration of the support arms is dependent on the article. Accordingly, it will be clear that other types of article supports can be utilized along with the invention.

In the prior art, the entire rack assembly, including supporting arms 22, is coated with a plastisol which prevents parasitic plating from collecting on the rack. The portion of the supporting arm upon which the article to be plated is supported is stripped of plastisol coating so that the article electrically contacts the plating rack. The area from which plastisol has been removed collects parasitic plating. Thus, it is necessary to remove this parasitic plating from time to time.

In accordance with the present invention a closed sleeve is placed over the end of each supporting arm which has been stripped of plastisol. The closed sleeve performs the function of insulating the supporting arm from the electrolyte bath but also serves to electrically connect the article to be plated and the supporting arm upon which it is supported at essentially their point of contact only. Thus, with sleeve of the present invention, there is essentially no point at which the electro-plating rack and electrolyte bath come into direct contact with one another. Accordingly, the tendency toward collection of parasitic plating is substantially minimized.

Figure 2:
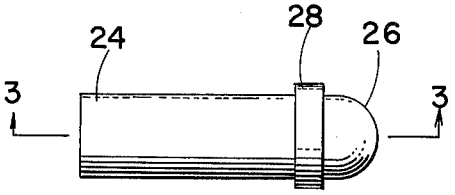
FIG. 2 is an elevational view of a first embodiment of the combination insulating sleeve and electrical contact of the invention.
Figure 3:
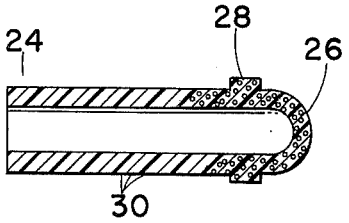
FIG. 3 is a cross-sectional view taken along lines 3—3 of FIG. 2.

The closed sleeve of the invention may take on different configurations depending on the shape of the support arm and for the shape of the article to be plated. Referring to FIGS. 2 and 3, the sleeve of the invention may be a unitary closed sleeve member having an insulating portion 24 and a pressure sensitive contact portion 26. The sleeve may be formed by conventional molding techniques and is preferably constructed of a plastisol material since that material has been highly used in the electro-plating art and is impervious and non-reactive to the chemicals used therein. As shown in FIGS. 2 and 3, the sleeve of the invention has a rib 28 in the pressure sensitive contact area which protrudes slightly above the surface thereof and which extends substantially completely around the outer periphery of the tubular sleeve.

The pressure sensitive contact portion 26 is preferably formed from the same material as the insulative portion 24 but has a plurality of electrically conductive particles 30 dispersed therein. The number and size of the particles 30 can vary within rather wide limits depending upon the base material within which it is dispersed, and the weight of the article which will be plated. Further, the number of particles can depend upon the size of the particles and the size of the particles can depend upon the number of particles. For example, the contact portion 26 is formed so that it is normally electrically nonconductive but becomes increasingly more conductive with increased pressure. If too many particles are dispersed in the contact portion, the material becomes conductive even in the absence of pressure. If too few particles are dispersed in the contact area, the contact area is normally nonconductive but cannot be rendered conductive with increased pressure or is not responsive to pressures created by the weight of the article to be plated. More specifically, Applicant has found that a suitable base material for the sleeve is a plastisol material available from Grow Chemical and identified as Product No. A-1008. The base plastisol may be modified to obtain different degrees of toughness and resiliency by adding a material sold under the trademark MICROSOL by Michigan Chrome and Chemical Co. The base material is prepared and molded in accordance with the manufacture's instructions except for the pressure sensitive contact portion in which a plurality of electrically conductive particles are dispersed by admixing the conductive particles with the base material prior to molding. The conductive particles may range in size from as large as −80 mesh to as small as +150 mesh and have yielded suitable results when mixed in a particulate to base weight % ratio in the range of 84.6% to 88.8%. Another suitable base material is a 96-083 Silicone Adhesive available from Dow Corning Corporation. It is intended that the base materials, particulate size and particulate to base weight % ratios stated herein be used for illustrative purposes only and not to be limiting.

Figure 4:
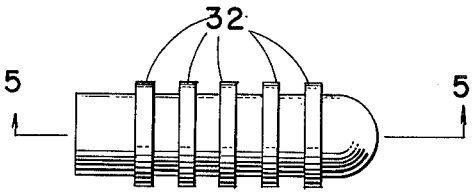
FIG. 4 is an elevational view of a second embodiment of the combination insulating sleeve and electrical contact of the invention.
Figure 5:
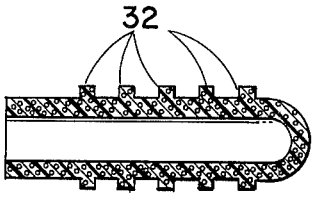
FIG. 5 is a cross-sectional view taken along lines 5—5 of FIG. 4.

In FIGS. 4 and 5, a second embodiment of the invention is disclosed. The embodiment of FIGS. 4 and 5 differs from that of FIGS. 2 and 3 in that it has a plurality of axially spaced ribs 32, each running around the outside of the sleeve. Further, the sleeve of FIGS. 4 and 5 differs from that of FIGS. 1 and 2 in that it is constructed entirely of pressure sensitive electrical contact material. As in the embodiment of FIGS. 2 and 3, the contact material from which the device of FIGS. 4 and 5 is constructed, is preferably a mixture of a plurality of metal particles and a plastisol. Further, the contact material is formed to be normally nonconductive but responsive to the weight of the article to be plated to become electrically conductive at the point of contact therewith to electrically connect the article and the rack. Due to the resiliency of the plastisol material, the sleeve returns to its normal nonconductive state when the article is removed.

Use of the sleeve of the invention should be clear to those skilled in the art, but for sake of clarity, will be described to ensure a complete understanding and use of the invention. In use, the sleeve is placed over the support arm 22 on the plating rack which has been previously coated with a plastisol material except for the portion which the sleeve is adapted to cover. The sleeve is adapted to snugly fit over the support arm and to abut against the plastisol material on the rack so that the rack is essentially insulated from the electrolyte bath whenever the rack assembly is placed therein. Whenever an article is placed over the sleeve covered support arm, the sleeve becomes conductive essentially at the point of contact to electrically connect the plating rack and article. Then, when the rack with articles thereon is immersed in a plating bath, very little parasitic plating occurs because the rack is not in direct electrical contact with the electrolyte bath. It will be appreciated that the force exerted on the sleeve by the article is concentrated on the ribs. Since pressure is force per unit area, the ribs have the effect of creating a greater pressure on the contact material than if the ribs were not present. Thus, the sleeve is rendered more sensitive as a result of the ribs.

In order to illustrate the substantial effect which the sleeve of the invention has in minimizing the parasitic plating problem, it should be noted that a sleeve constructed in accordance with the present invention has been tested in actual use on a plating rack. In the test, the plating rack with the sleeve of the invention has survived over 100 trips through a plating bath with a new article being suitably plated each time. In the past, it was necessary to remove the parasitic plating after as few as 2 or 3 trips through the plating bath. Thus, it is clear that the sleeve of the invention has provided a definite improvement over the prior art.

The invention has been described in connection with two illustrative embodiments thereof which are not intended to be limiting. The scope of the invention is defined in the claims.

What is claimed is:

1. In an electroplating apparatus for plating an electrically conductive article, including an electrically conductive rack and supporting means thereon for supporting said article, an electrolyte bath into which said article is immersed, an electrically insulating coating on that portion of said rack and supporting means which is immersed into said electrolyte bath, a portion of said electrically insulating coating on said supporting means being removed to form a contact area at which said article and rack electrically connect one another, the improvement which comprises:

a composite electrical contact interposed between said supporting means and said article at said contact area, said composite electrical contact comprising a unitary body having an insulative portion and a resilient, normally non-conductive pressure sensitive contact portion, the surface of said pressure sensitive contact portion facing said article being ribbed such that the ribs extend above the surface of said insulative portion, whereby the ribs are conductive when compressed by the article being plated.

2. The improvement as claimed in claim 1, wherein said insulative portion is formed of a curable, resilient, elastomeric, compressible base material and said pressure sensitive contact portion is formed of a curable, resilient, elastomeric, compressible base material having a plurality of electrically conductive particles admixed therewith.

3. The improvement as claimed in claim 2, wherein said base material for said insulative portion and said base material for said pressure sensitive contact portion are both plastisol materials.

* * * * *